United States Patent [19]

Kaneko

[11] 4,285,508

[45] Aug. 25, 1981

[54] COLLATOR

[75] Inventor: Tamaki Kaneko, Fujisawa, Japan

[73] Assignee: Ricoh Co., Ltd., Tokyo, Japan

[21] Appl. No.: 107,768

[22] Filed: Dec. 28, 1979

[30] Foreign Application Priority Data

Dec. 29, 1978 [JP] Japan ..... 53-161793

[51] Int. Cl.[3] ..... B65H 39/11; B65H 39/07

[52] U.S. Cl. ..... 271/4; 271/290; 271/291; 271/296; 271/297; 271/65

[58] Field of Search ..... 271/297, 296, 291, 287, 271/288, 289, 290, 4, 65, 186, DIG. 9

[56] References Cited

U.S. PATENT DOCUMENTS

| | | | |
|---|---|---|---|
| 2,661,209 | 12/1953 | McGalliard | 271/297 |
| 3,467,371 | 9/1969 | Britt et al. | 271/297 X |
| 3,774,906 | 11/1973 | Fagan et al. | 271/297 X |
| 4,200,386 | 4/1980 | Queener | 271/287 X |

OTHER PUBLICATIONS

Harding, S. R., "Sheet Turnover Device", *IBM Technical Disclosure Bulletin,* vol. 18, No. 1, Jun. 1975, p. 40.

*Primary Examiner*—Bruce H. Stoner, Jr.
*Attorney, Agent, or Firm*—McGlew and Tuttle

[57] ABSTRACT

A collator being adapted to receive and carry copy sheets from a copying machine and distribute the copy sheets to a plurality of bins arranged in series for storing the copy sheets. The collator is provided with a copy sheet feeding table and a copy sheet feeding mechanism for sending, one by one, the copy sheets stacked on the copy sheet feeding table. It results that copy sheets received in an over-flow tray or produced by other copying machines can be collated or sorted automatically in the collator according to the invention.

8 Claims, 9 Drawing Figures

COLLATOR

BACKGROUND OF THE INVENTION

The present invention relates to a collator comprising means for receiving and carrying copy sheets supplied from the copying machine, a plurality of bins arranged in series for receiving the collated or sorted copy sheets and means arranged movably along the series of the bins for distributing the copy sheet from the receiving and carrying means to a selected one of the bins.

In the collator of this type, when copy sheets from the copying machine are received in a over-flow tray due to any jam in a transporting path of the copy sheets to the series of the bins or the respective bins being fully occupied by the copy sheets, the over-flown copy sheets in the over-flow tray have to be removed therefrom and treated manually thereafter. Further, when it is desired to turn-over the copy sheets from the copying machine during the transportation thereof for purposes such as an arrangement of pages of the sheets, a specially designed turn-over mechanism has to be provided separately in the upstream of the collater.

SUMMARY OF THE INVENTION

A primary object of the present invention is to eliminate the above described disadvantages inherent to the conventional collator.

The above object of the present invention can be achieved by providing a sheet table for receiving a stack of copy sheets and a sheet transporting mechanism for transporting the sheets, one by one, to the transportation path extending to the series of the bins.

It is a further object of the invention to provide an apparatus for sorting and collating sheets of the type having a plurality of bins for receiving the sheets which have been sorted and collated and means for distributing the sheets to a predetermined one of the bins which includes first roller means for engaging and conveying each of the sheets through a feedpath to a distributor means, a feeding table for receiving a stack of sheets to be sorted, second roller means rotatably mounted adjacent the feeding table for engaging the uppermost sheet of the stack and conveying the uppermost sheet to the first roller means, and means for receiving and conveying the sheets to be collated to the first roller means. The apparatus, in a preferred embodiment, includes a branching plate means selectively movable between a first position and a second position for guarding the sheets conveyed by the first roller means to alternate locations.

Other objects and features of the present invention will become apparent by reading the detailed description of the preferred embodiment of the present invention with reference to the accompanying drawings.

It is a further object of the present invention to provide an apparatus for sorting and collating sheets which is simple in design, rugged in construction and economical to manufacture.

DETAILED DESCRIPTION OF THE PREFERRED EMBODIMENT

Figure 1:
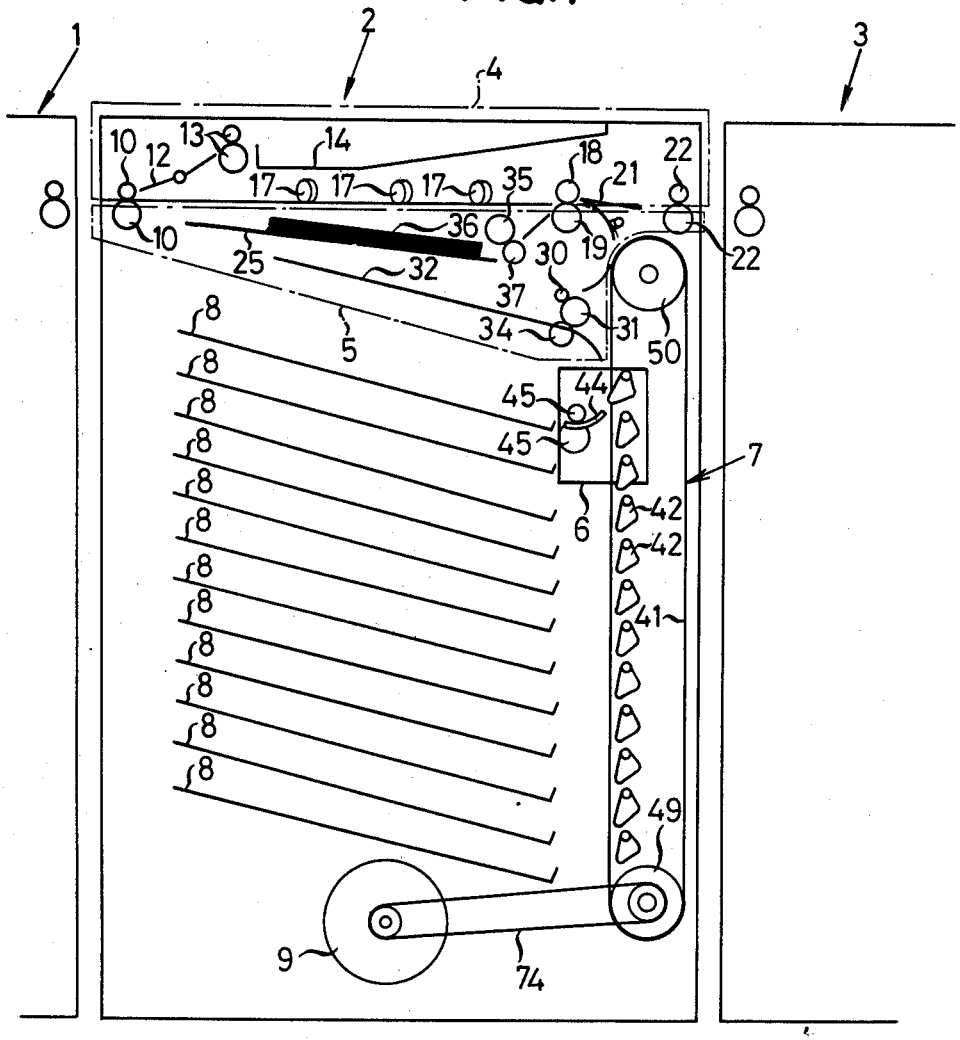
FIG. 1 is a schematic illustration of a collator of the present invention in vertical cross-section.

In FIG. 1, a first collator 2 is arranged adjacent to a copying machine 1 and a second collator 3 is arranged in the downstream of the collator 2. Copy papers supplied from the copying machine 1 are transferred to the first collator 2 and, then, through the latter to the second collator 3, if necessary.

The first collator 2 according to the present invention comprises a copy sheet arranging section 4, a feeder portion 5 disposed beneath the section 4, a vertically movable distributer 6 for distributing the copy sheet to a selected one of bins, a transporting section 7 for carrying the distributer 6 and for transporting the copy sheets from the arranging section 4 or the feeder portion 5 to the distributer 6, a plurality of the bins 8 arranged in series vertically and adapted to receive and store the copy sheets fed from the distributer 6 and a motor 9 for driving various portions of the collator 1. The second collater 3 may be constructed in the same matter as that of the first collator 2 and, therefore, only the first collater 2 will be described in detail hereinafter.

I. COPY SHEET ARRANGING SECTION 4

Functions of the copy sheet arranging section 4 can be generalized as follows:

(1) Reliable reception of the copy sheets supplied from the copying machine.

(2) Storage of the copy sheets from the copying machine in case of emergency.

(3) Lateral transfer of the copy sheet to a predetermined position and registration thereat.

(4) Feeding of the registered copy sheets to the distributer.

(5) Feeding of the copy sheets to the second collater 3.

(6) Detection of the size and timing of the copy sheets received.

The construction and the function of the copy sheet arranging portion 4 will now be described in detail with reference to FIGS. 2 and 3.

Figure 2:
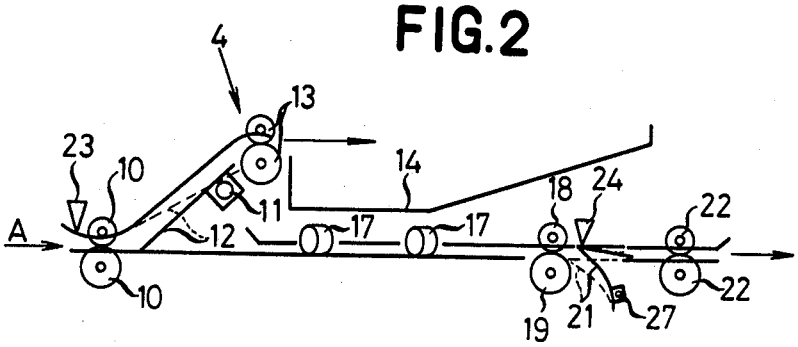
FIG. 2 is a vertical cross-section of a sheet arranging section of the collater in FIG. 1.
Figure 3:
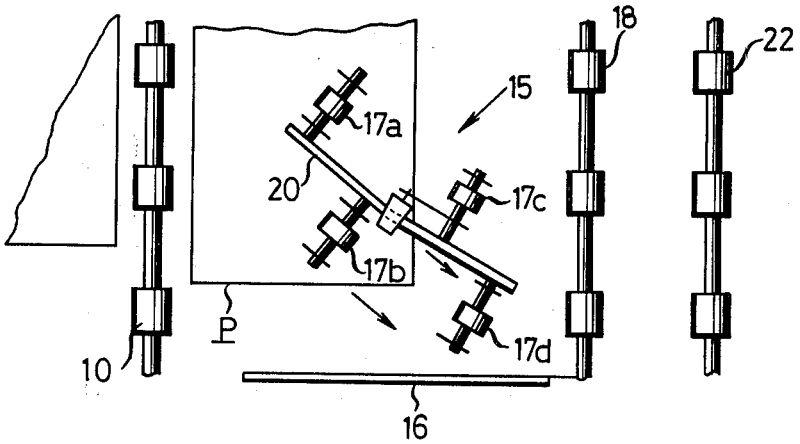
FIG. 3 is a plane view of the slanted roller portion of the collater in FIG. 1.

In FIGS. 2 and 3, the copy sheet supplied from the copying machine 1 is moved in the direction shown by the arrow A to the first collator 2. The copy sheet is pinched by a pair of rollers 10 disposed around an entrance portion of the arranging section 4 and is guided to a guide plate 12 having one end portion pivotably secured to a shaft 11 that is controlled by a solenoid (not shown). Then, the copy sheet is guided along the guide plate 12 and transferred through a pair of ejection rollers 13 to an ejection tray 14.

In the case where the copy sheet is to be sorted or collated, the guide plate 12 is pivoted upwardly about shaft 11 to allow the sheet to pass horizontally to a slanted roller portion 15. In the latter case, the present collator can operate in either of two modes, namely, in a sorting mode or a collating mode. Although the present invention is titled as "collator", the term "collator" as used in this specification, should be interpreted as an apparatus which functions selectively to sort or collate the copy sheet.

In the slanted roller portion 15, two pairs of slanted rollers 17*a*, 17*b*, 17*c* and 17*d* are arranged. The copy sheet P (FIG. 3), which has entered into the slanted roller portion 15, is guided to a reference plate 16 by the slanted rollers. The reference plate 16 positions and orients the copy sheet which is then fed to a pair of intermediate rollers 18 and 19. The slanted rollers 17*a* and 17*b*, disposed in the upstream side of the slanted roller portion, are supported by parallel shafts slanted by a certain angle with respect to an axis of the roller 10, and the slanted rollers 17*c* and 17*d*, disposed adjacent to the intermediate rollers 18 and 19, are supported by parallel shafts slanted by an angle smaller than the aforesaid certain angle with respect to the shaft of the roller 10, so that the feeding rate component in the direction of the arrow A which is given by the roller pair 17*c* and 17*d* becomes larger than that given by the roller pair 17*a* and 17*b*. Therefore, the moving direction of the copy sheet is changed through two steps by the slanted rollers 17*a* to 17*d*. With this two-step change of the moving direction of the copy sheet, it becomes possible to shift the copy sheet being moved in the arrow direction to the reference plate 16 even if the size of the copy sheet is very small.

The slanted rollers 17*a* to 17*d* are rotated by a common belt 20. Since the peripheral rotation speed of each of the slanted rollers is selected as being larger than that of the roller 10, the moving speed of the copy sheet P in the advancing direction can be maintained at a sufficient value regardless of the lateral shift thereof.

The copy sheet advanced along the reference plate 16 is pinched between the intermediate rollers 18 and 19 and, then, directed by a branch plate 21, provided in the feeder 5, to the transporting section 7 or through a pair of feeding-out rollers 22 to the second collator 3.

A first optical sensor 23 is provided in front of the receiving rollers 10 and a second optical sensor 24 is provided behind the intermediate rollers 18, 19. The first optical sensor 23 detects the time or receipt of the copy sheet supplied to the first collater and the size thereof. The second optical sensor 24 detects the discharge of the copy sheet from a sheet feeding portion of the feeder to be described hereafter and also functions in conjunction with the first optical sensor 23 to detect a jam when the copy sheet is to be fed to the second collator 3. When the jam of the copy sheet or any malfunction occurs in the downstream side of the slanted rollers, all rollers except the receiving rollers 10 and the ejecting rollers 13 are stopped in rotation and the guide plate 12 is shifted to a position shown by a solid line. In such case, the succeeding copy sheets are fed directly to the tray 14. Therefore, at least a portion of the possible trouble between the copying machine and the collator can be eliminated. Furthermore, when the number of copy sheets supplied to the collator exceeds the capacity of the latter, the guide plate 12 is operated in the same manner as above, so that the excess sheets are supplied to the tray 14. Thus, the latter can be also used as an overflow tray.

II. FEEDER PORTION 5

The functions of the feeder portion 5 are summarized as follows:

(1) Directing the copy sheet arranged in the sheet arranging section 4 toward the transporting section.
(2) Turning over the copy sheets supplied.
(3) Feeding, one by one, the stacked copy sheets.

Figure 4:
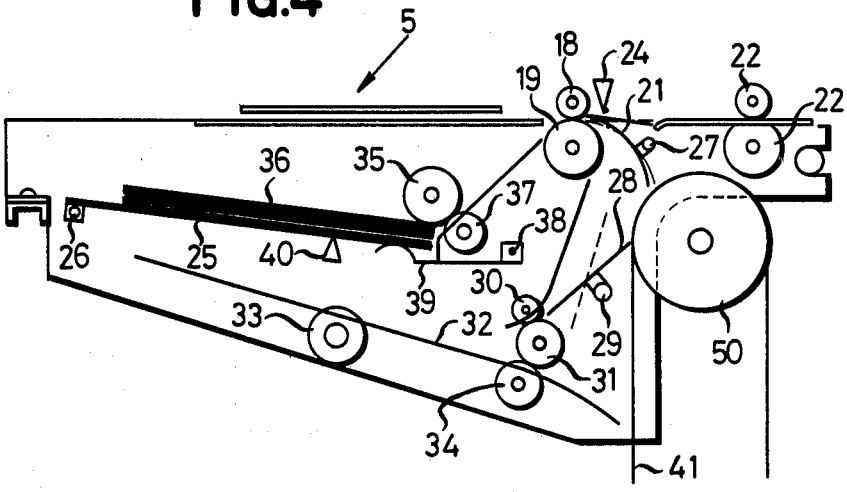
FIG. 4 is a cross section of the sheet feeder portion of the collater in FIG. 1.

In FIG. 4, the feeder portion 5 is an assembly provided separately from the sheet arranging section 4 and is detachable from a body frame of the collator. The feeder portion 5 and the sheet arranging section 4 are hinged at rear sides thereof such that the front side of the sheet arranging section 4 can be lifted up. Therefore, the removal of jammed copy sheets in the transportation path and a setting of a stack of the copy sheets on the feeding table 25 are facilitated. Furthermore, by removing the feeder portion 5 from the body frame of the collator, a driving mechanism of the latter, the series of the bins 8, the transporting section 7 and the distributer 6 are exposed. Therefore, the maintenance of the collator is very much facilitated.

The copy sheet is fed along the reference plate 16 of the sheet transporting section 4, pinched by the intermediate rollers 18 and 19 and guided by the branch plate 21, whose position is shown by the solid line, to the transporting section 7. The positioning of the branch plate 21 is controlled by a solenoid (not shown) which affects an arm (not shown) provided on a shaft 27 of the plate 21.

When the copy sheet is to be fed to the second collator 3, the solenoid is deenergized and the branch plate 21 is returned by a biasing spring (not shown) to the position shown by a broken line, so that the copy sheet is fed through the rollers 22 to the second collator 3.

Turning-over of the copy sheet will now be described. The feeding of the copy sheet to the transporting section 7 was explained previously. The copy sheet thus fed to the transporting section 7 is guided to a turn-over branch plate 28 along which the copy sheet is fed to a turn-over portion. The turn-over branch plate 28 includes a rotary shaft 29 which is provided with an arm (not shown) which is connected to a solenoid (not shown). When the solenoid is energized, the branch plate 28 takes a position shown by a solid line. The copy sheet is directed by the branch plate 28 in that position to a first pair of turn-over rollers 30 and 31 through which the copy sheet is fed onto a turn-over table 32. A returning roller 33 is provided in an intermediate portion of the turn-over table and continuously rotates to return the copy sheet. The copy sheet passed through the rollers 30 and 31 is put on the table 32, and then, with the aid of the inclination of the latter and the rotation of the returning roller 33, it is fed through a second roller pair 31 and 34 to the transporting section 7, which results in a turn-over of the copy sheet.

When the copy sheets stored on the tray 14 or copy sheets copied by another copying machine are to be collated or sorted, they are put on the copy sheet feeding table 25. When a copy sheet feeding start instruction is supplied, a sheet feeding roller clutch (not shown) is connected and a feeding roller 35 starts to rotate and engages each sheet of a stack of copy sheets 36 so that each sheet is fed, one by one, commencing with the uppermost sheet. When the front edge of the uppermost sheet is passed through the intermediate rollers 18 and 19 and detected by a second optical sensor 24, located downstream of the intermediate rollers, the roller clutch is disconnected and the rotation of the feeding roller 35 is interrupted while the sheet continues to pass through between the rollers 18 and 19. In this case, a separating roller 37, which makes a suitable pressure contact with the roller 35 and rotates in opposite direction to that of the feeding roller 35 or may be stationary, is provided, by which the "one-by-one" feeding of the copy sheet is ensured. A pressure lever 39 supported at one end thereof by a shaft 38 is provided beneath the sheet feeding table 25. The shaft 38 is formed integrally with an arm which are connected to a solenoid (not shown). When the copy sheet feeding instruction is provided, the solenoid is energized to rotate the pressure lever 39 in a clockwise direction through the arm integrally formed on the shaft 38. Upon the clockwise rotation of the pressure lever 39, the sheet feeding table 25 is lifted up and the uppermost copy sheet contacts with the feeding roller 35 with a suitable pressure. An optical sensor 40 is also provided to detect a presence or absence of the copy sheet on the feeding table 25.

III. DISTRIBUTER 6

The main functions of this distributer 6 are as follows:

(1) Reliable deflection of the copy sheets supplied.

(2) Reliable feeding of the deflected copy sheets to the bins.

(3) Downward movement thereof by a predetermined distance and upward movement thereof to a predetermined position.

(4) Acknowledgement of feeding of the copy sheets to the bins.

Figure 5:
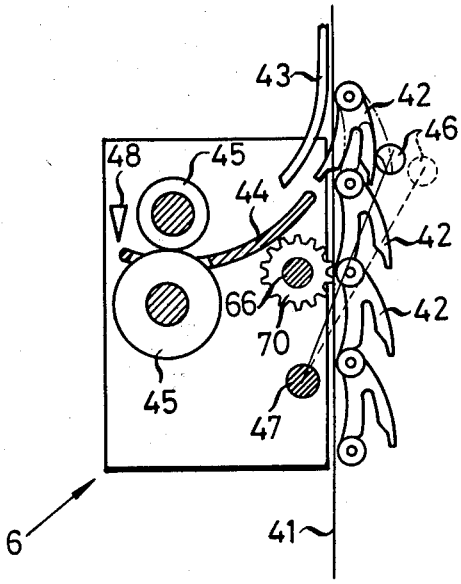
FIG. 5 is a schematic illustration which illustrates a mutual relation between an outlet portion of the sheet distributor and a direction selector cam for determining the transporting direction of the copy sheets.

In FIG. 5, a deflection cam 42 is provided for each of the bins. The deflection cam 42, at which the distributer 6 is positioned to feed the copy sheet to the corresponding bin, is protruded from the belt 41 of the transporting section 7. Therefore, the copy sheet sent by the belt 41 to the distributer 6 is separated from the belt 41 by a concaved plane of the deflection cam and fed to the bin through guide plates 43 and 44 and a pair of feeding rollers 45 provided in the distributor 6. The deflection cam 42 is held at the protruded position by locking a deflection cam driving lever 46 mounted on the distributer 6 in a position shown by a solid line. When the distributer 6 is lowering, the lever 46 is in the position shown by the solid line to protrude a desired one of the deflection cams from a plane defined by the belt 41. However, when the distributer 6 is being moved upwardly, the lever 46 takes a position shown by a broken line so that the lever 46 does not contact any deflection cams. A solenoid 47 for effectuating the above operation is provided in the distributer 6. An optical sensor 48 detects the rear edge of the copy sheet fed to the bin to acknowledge the feeding timing, the feeding position and the number of the copy sheets fed.

Now an elevating mechanism for the distributer will be described.

Figure 6:
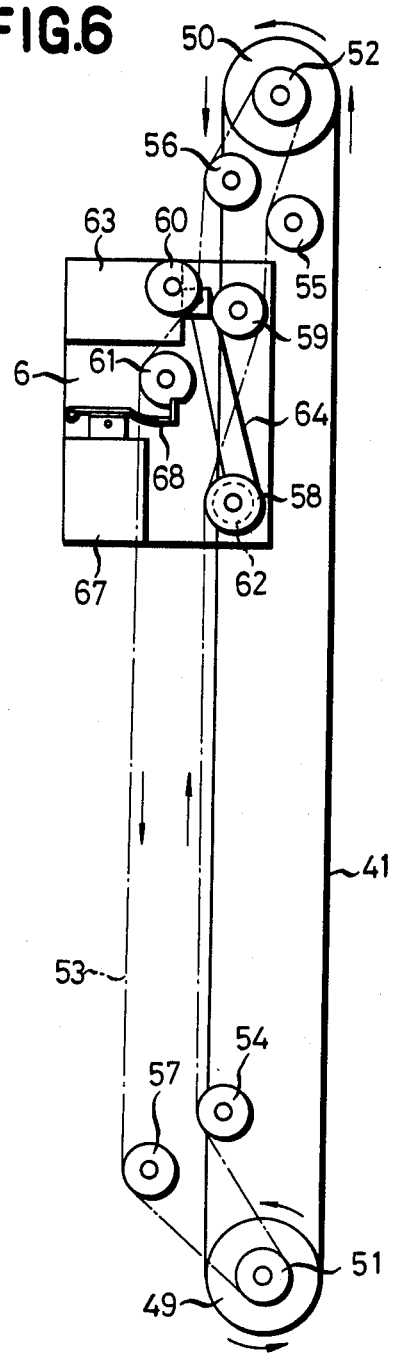
FIG. 6 schematically illustrates a mutual relation between the distributer and the driving mechanism associated therewith.

As shown in FIG. 6, the belt 41 is supported by a driving roller 49 and driven roller 50 and a first chain 53 is supported by a sprocket 51 fixedly secured to a shaft of the driving roller 49 and a sprocket 52 supported in free rotation by a shaft of the driven roller 50. In this case, the diameter of the sprocket 51 is smaller than that of the driving roller 49, so that the moving speed of the chain 53 is lower than that of the belt 41. Furthermore, the chain 53 passes through sprockets 54, 55, 56 and 57 provided in the transporting section 7 and sprockets 58, 59, 60 and 61 provided in the distributer 6.

The distributer 6 is moved upwardly when the sprockets of the distributer and a portion of the chain 53, which goes upwardly, are locked with each other and moved downwardly when the distributer and a portion of the chain 53, which goes downwardly, are locked with each other. For this purpose, a clutch 62 is provided on the sprocket 58 mounted on a fixed shaft of the distributer 6.

The clutch 62 is controlled by a solenoid 63 through a lever 64 in such a manner that upon energization of the solenoid 63 the clutch 62 is disconnected to allow the sprocket 58 to rotate freely and therefore the chain 53 can rotate above without the upward movement of the distributer 6. When the solenoid 63 is deenergized, the lever 64 returns to its original position by a biasing spring, so that the sprocket 58 is locked to the fixed shaft thereof through the clutch 62. Therefore, the sprocket 58 and hence the distributer 6 is caught by the portion of the chain 53 which is going upwardly. When the distributer reaches a position at which it should be stopped, it actuates a switch. Upon the actuation of the switch, the solenoid 63 is energized to disconnect the clutch 62. Therefore, the distributer 6 is disconnected from the chain 53 and stops thereat.

The downward movement of the distributer 6 is basically the same as the above mentioned upward movement thereof. However, in the downward movement, the distance of movement should be exactly the same as a given distance.

Figure 7:
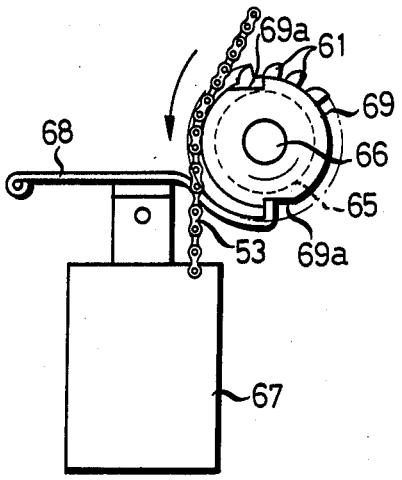
FIG. 7 is a schematic illustration of a clutch control mechanism of the distributer.
Figure 8:
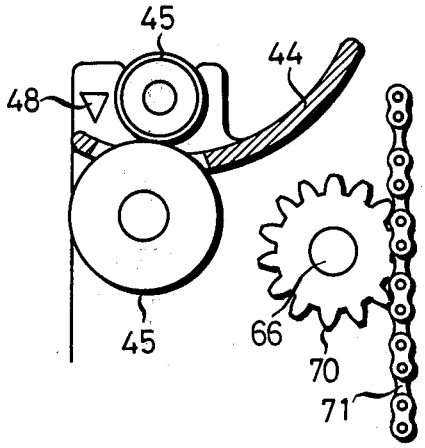
FIG. 8 illustrates a mechanism for a stepped feeding of the sheet distributer.

For this purpose, there is provided a sprocket 61 meashed with the downwardly going portion of the chain 53, a clutch 65 provided for the sprocket 61, a clutch shaft 66, a solenoid 67 for controlling the clutch, a lever 68 coupled to a plunger of the solenoid and a cam sleeve 69 having a notch **69*a* adapted to detachable engage with one end of the lever 68 and to control the clutch 66, as shown in FIG. 7. Another sprocket 70 is fixedly secured to the shaft 66 of the clutch 65 as shown in FIG. 8. The sprocket 70 meshes with a second chain 71 which is fixed to the transporting section 7** and thus stationary.

When the solenoid 67 is deenergized, the engaging end of the lever 68 engages with the notch **69*a* of the cam sleeve 69 to disconnect the clutch 65. Therefore, the shaft 66 does not rotate even if the sprocket 61 is rotated by the chain 53 and thus the distributer 6** is stopped.

When the solenoid 67 is energized, the engaging end of the lever 68 goes out from the notch **69*a* of the cam sleeve and the clutch 65 is connected. Therefore, the rotation of the sprocket 61 due to the downwardly going portion of the chain 53 is transmitted to the shaft 66 to cause the sprocket 70 to rotate with the shaft 66. In this case, the sprocket 70 rotates along the fixed chain 71. As a result the distributer 6** goes downwardly.

The solenoid 67 is deenergized again immediately after the engaging end of the lever 68 goes out from the notch **69*a* of the cam sleeve. Therefore, the engaging end of the lever 68 slides on and along the peripheral face of the cam sleeve 69 while keeping the contact therewith and when the cam sleeve 69 rotates by 180°, it engages with another notch 69*c* to stop the rotation of the cam sleeve. At this time the clutch 65 is disconnected again and thus the shaft 66 and the sprocket 70 fixed thereto and hence the distributer 6 is stopped. In this manner, the distributer 6 goes downwardly by a distance exactly corresponding to a half of a revolution of the cam sleeve 69**. This distance corresponds to the distance between the adjacent bins.

Instead of the chains 53 and 71, it is possible to use belts, especially, timing belts.

IV. TRANSPORTING SECTION 7

The main functions of the transporting section 7 are as follows:

(1) Reliably transporting the copy sheets to the distributer.

(2) Moving the distributer vertically.

Figure 9:
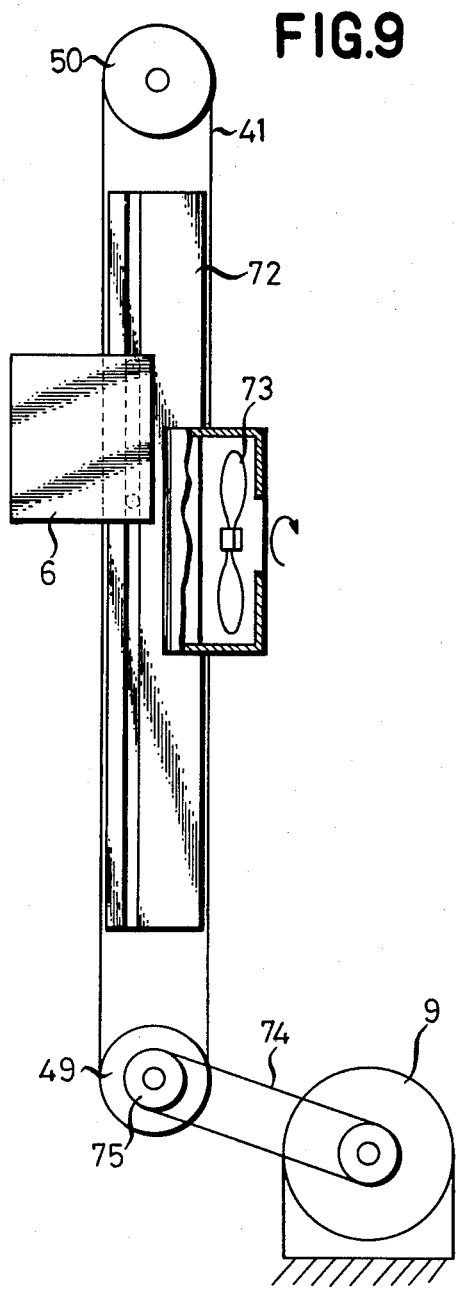
FIG. 9 illustrates a transporting section for the copy sheets.

In FIG. 9, a vacuum chamber 72 is arranged in an area defined by the belt 41 supported by the driving roller 49 and the driven roller 50 and is always kept at a negative pressure by a blower 73. One of walls defining the vacuum chamber 72, which faces to the series of the bins and is adjacent to the one side of the transporting belt, is formed with a number of suction holes. The transporting belt 41 is formed a number of suction holes corresponding to those of the wall. The copy sheet is attracted to the belt in a position at which the suction holes of the wall and those of the belt 41 are registered and moved with the belt to the distributer 6. The copy sheet is deflected in moving direction by the deflecting cam 42 of the distributer 6 and fed to a selected bin. The driving roller 49 is rotated by a motor 9 through a belt 74 and a pulley 75.

As mentioned above, by the collator according to the present invention the copy sheets and the like supplied onto the overflow tray can be automatically distributed to the respective bins with the turning-over thereof, if necessary, regardless of the copying machine.

While specific embodiments of the invention have been shown and described in detail to illustrate the application of the principles of the invention, it will be understood that the invention may be embodied without departing from such principles.

What is claimed is:

1. An improved collator of the type having copy sheet distributing means, means for receiving and carrying copy sheets produced by and supplied from a copying machine along a copy sheet transportation path to the distributing means, a plurality of bins arranged in a vertical array for storing the copy sheets, and wherein the distributing means is movably arranged along inlets of the bins for distributing the copy sheets from the receiving and carrying means to a predetermined one of said bins, the improvement, in combination therewith, comprising a copy sheet feeding table mounted above the vertical array of bins and arranged out of the copy sheet transportation path for receiving the copy sheets in a stack, a copy sheet feeding mechanism for sending, one by one, the copy sheets on said copy sheet feeding table through the copy sheet transportation path to said bins, and means removably mounted above the copy sheet feeding table and enclosing the copy sheet transportation path operable to expose the feeding table and the copy sheet transportation path thereby permitting the removal of copy sheets jammed in the transportation path and the setting of copy sheets on the feeding table.

2. A collator as set forth in claim 1, further comprising a copy sheet ejection tray and a switchable receiving guide plate for guiding the copy sheets supplied to said collator selectively to said copy sheet ejection tray or to said transportation path to said bins.

3. A collator, as set forth in claim 1, further comprising a copy sheet turn-over mechanism, said mechanism including a turn-over table, a switchable turn-over branch plate for guiding the copy sheets from said transportation path to said bins to said turn-over table and a roller mechanism for returning the copy sheets turned-over and put on said turn-over table to said transportation path to said series of said bins.

4. A collator, as set forth in claim 2, further comprising a copy sheet turn-over mechanism, said mechanism including a turn-over table, a switchable turn-over branch plate for guiding the copy sheets from said transportation path to said bins to said turn-over table and a roller mechanism for returning the copy sheets turned-over and put on said turn-over table to said transportation path to said series of said bins.

5. An apparatus for sorting and collating sheets of the type having a frame, a plurality of bins arranged in a vertical array and mounted to the frame for receiving the sheets which have been produced and supplied from a copying machine and means for distributing the sheets along a transportation path to a predetermined one of the bins comprising sheet arranging means including first roller means for engaging and conveying each of the sheets through the transportation path to the distributor means, a feeding table mounted above the vertical array of bins and arranged out of the transportation path for receiving a stack of sheet to be sorted, second roller means rotatably mounted adjacent said feeding table for engaging the uppermost sheet of said stack and conveying the uppermost sheet to said first roller means, means for receiving and conveying sheets to be collated to said first roller means, said sheet arranging means being pivotably mounted to the frame above the sheet feeding table and enclosing the copy sheet transportation path and being pivotable to expose said feeding table and the copy sheet transportation path thereby permitting the removal of copy sheets jammed in the transportation path and the setting of copy sheets on the feeding table.

6. The apparatus according to claim 5, wherein said sheet arranging means further comprises branching plate means selectively movable between a first position and a second position for guiding the sheets conveyed by said first roller means to alternate locations.

7. The apparatus according to claim 6, further comprising turnover means disposed downstream of said first roller means for turning over each of the sheets conveyed through the transportation path.

8. The apparatus according to claim 7, wherein said turnover means includes a turn-over table, a branch plate selectively movable between a first position and a second position, third roller means for conveying said sheets from said branch plate to said turn-over table and from said turn-over table to the distributor means.

* * * * *